US010020094B2

(12) United States Patent
Lancaster

(10) Patent No.: US 10,020,094 B2
(45) **Date of Patent: *Jul. 10, 2018**

(54) HYBRID CONDUCTOR CORE

(71) Applicant: Southwire Company, LLC, Carrollton, GA (US)

(72) Inventor: Mark A. Lancaster, Brooks, GA (US)

(73) Assignee: Southwire Company, LLC, Carrollton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/289,234

(22) Filed: Oct. 10, 2016

(65) Prior Publication Data

US 2017/0025202 A1 Jan. 26, 2017

Related U.S. Application Data

(63) Continuation of application No. 14/203,922, filed on Mar. 11, 2014, now Pat. No. 9,490,050.

(Continued)

(51) Int. Cl.

| | |
|---|---|
| ***H01B 5/08*** | (2006.01) |
| ***H01B 9/00*** | (2006.01) |
| ***H01B 5/10*** | (2006.01) |

(52) U.S. Cl.

CPC ..... *H01B 9/006* (2013.01); *H01B 5/102* (2013.01); *H01B 9/008* (2013.01)

(58) Field of Classification Search

CPC ..... B29B 15/122; B29C 70/523; D07B 1/16; D07B 1/0693; D07B 2201/2009;

(Continued)

(56) References Cited

U.S. PATENT DOCUMENTS

| | | | | |
|---|---|---|---|---|
| 4,097,686 A | | 6/1978 | Gladenbeck et al. | |
| 5,198,621 A | * | 3/1993 | Kojima | D07B 1/147 174/128.1 |

(Continued)

FOREIGN PATENT DOCUMENTS

| | | |
|---|---|---|
| CH | 671647 A5 | 9/1989 |
| JP | 487212 | 3/1992 |

OTHER PUBLICATIONS

International Searching Authority (Partial Search Report) dated Jul. 3, 2014 cited in Application No. PCT/US2014/023271.

(Continued)

*Primary Examiner* — Timothy Thompson
*Assistant Examiner* — Guillermo Egoavil
(74) *Attorney, Agent, or Firm* — Merchant & Gould P.C.

(57) ABSTRACT

An electric conductor may be provided. The electric conductor may comprise a conductor core and a plurality of conductor strands wrapped around the conductor core. The conductor core may comprise a plurality of core strands comprising an overall number of strands. The plurality of core strands may comprise a first portion of core strands and a second portion of core strands. The first portion of core strands may comprise a first number of strands. The first portion of core strands may comprise steel. The second portion of core strands may comprise a second number of strands. The second portion of core strands may comprise a composite material. A ratio of the first number of strands to the overall number of strands and a ratio of the second number of strands to the overall number of strands may be optimized to give the conductor core a predetermined characteristic.

20 Claims, 2 Drawing Sheets

Related U.S. Application Data

(60) Provisional application No. 61/775,816, filed on Mar. 11, 2013.

(58) Field of Classification Search

CPC .... D07B 2201/2041; D07B 2201/2036; D07B 2205/3096; D07B 2205/2014; D07B 2205/3003; D07B 2205/3017; D07B 2205/205; D07B 2401/2005; D07B 5/006; H01B 1/02; H01B 1/04; H01B 1/023; H01B 1/026; H01B 3/427; H01B 3/428; H01B 5/102; H01B 5/105; H01B 7/14; H01B 7/045; H01B 7/182; H01B 7/18; H01B 9/008; H01B 9/006; H01B 9/003; H01B 9/04; H01B 13/22; H01B 13/00; H01B 13/0036; H01R 43/00; F16F 15/06; F16F 15/03; F16F 2224/0258; Y10T 29/49195; Y10T 29/49117; Y10T 29/49201

USPC ..... 174/102 R, 102 A, 128.1, 131 A, 128.2, 174/113 R; 29/872; 52/167.8; 156/56; 187/411; 977/742, 932

See application file for complete search history.

(56) References Cited

U.S. PATENT DOCUMENTS

| | | | | |
|---|---|---|---|---|
| 7,683,262 | B2 * | 3/2010 | Guery | H01B 3/427 174/102 R |
| 9,490,050 | B2 * | 11/2016 | Lancaster | H01B 5/102 |
| 2004/0182597 | A1 | 9/2004 | Smith et al. | |
| 2007/0251204 | A1 * | 11/2007 | Susai | H01B 13/0006 57/9 |
| 2008/0233380 | A1 | 9/2008 | Hiel et al. | |
| 2008/0307723 | A1 | 12/2008 | Smith et al. | |
| 2011/0259677 | A1 * | 10/2011 | Dudde | B66B 7/062 187/411 |
| 2012/0168199 | A1 | 7/2012 | McCullough et al. | |
| 2012/0261158 | A1 | 10/2012 | Daniel et al. | |
| 2012/0298403 | A1 * | 11/2012 | Johnson | D07B 1/02 174/130 |
| 2013/0167502 | A1 * | 7/2013 | Wilson | B29C 70/025 57/210 |
| 2013/0291993 | A1 | 11/2013 | Ruby et al. | |
| 2014/0251653 | A1 | 9/2014 | Lancaster | |

OTHER PUBLICATIONS

International Search Report dated Oct. 9, 2014 cited in Application No. PCT/US2014/023271 , 17 pgs.

Advances in Thermoplastic Matrix Composite Materials _1989 pp. 154_204-204_& 252.

Coefficient of Thermal Expansion of Carbon Epoxy Composites_2003.

20-p2148_thermal expansion of carbon fiber reinforced_2010.

Coefficients of Linear Thermal Expansion_Engineering Toolbox_Jan. 2012.

* cited by examiner

HYBRID CONDUCTOR CORE

RELATED APPLICATIONS

This application is a Continuation of co-pending U.S. application Ser. No. 14/203,922 entitled "Hybrid Conductor Core" filed Mar. 11, 2014, now U.S. Pat. No. 9,490,050, which claims the benefit under provisions of 35 U.S.C. § 119(e) of U.S. Provisional Application No. 61/775,816, filed Mar. 11, 2013 entitled "Hybrid Conductor Core", which are incorporated herein by reference.

COPYRIGHTS

All rights, including copyrights, in the material included herein are vested in and the property of the Applicant. The Applicant retains and reserves all rights in the material included herein, and grant permission to reproduce the material only in connection with reproduction of the granted patent and for no other purpose.

BACKGROUND

There are many types of overhead conductor designs. One such conductor design is Aluminum Conductor Steel Reinforced (ACSR). ACSR conductor is a high-capacity, high-strength stranded power cable used as electrical conductors in overhead power lines. The outer strands in an ACSR conductor are aluminum. Aluminum has very good conductivity, low weight, and relatively low cost. The center strands (i.e., core) in an ACSR conductor are made of steel, which provides extra strength for the ACSR conductor. The lower electrical conductivity of the steel core has only a minimal effect on the overall current-carrying capacity of the conductor due to the "skin effect." With the skin effect, most of the current in an ACSR conductor is carried by the aluminum portion of the conductor. Consequently, the higher resistance of the steel strands has only a small effect on the conductor's overall resistance.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

An electric conductor may be provided. The electric conductor may comprise a conductor core and a plurality of conductor strands wrapped around the conductor core. The conductor core may comprise a plurality of core strands comprising an overall number of strands. The plurality of core strands may comprise a first portion of core strands and a second portion of core strands. The first portion of core strands may comprise a first number of strands. The first portion of core strands may comprise steel. The second portion of core strands may comprise a second number of strands. The second portion of core strands may comprise a composite material or Aluminum or Aluminum alloy. A ratio of the first number of strands to the overall number of strands and a ratio of the second number of strands to the overall number of strands may be optimized to give the conductor core a predetermined characteristic.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
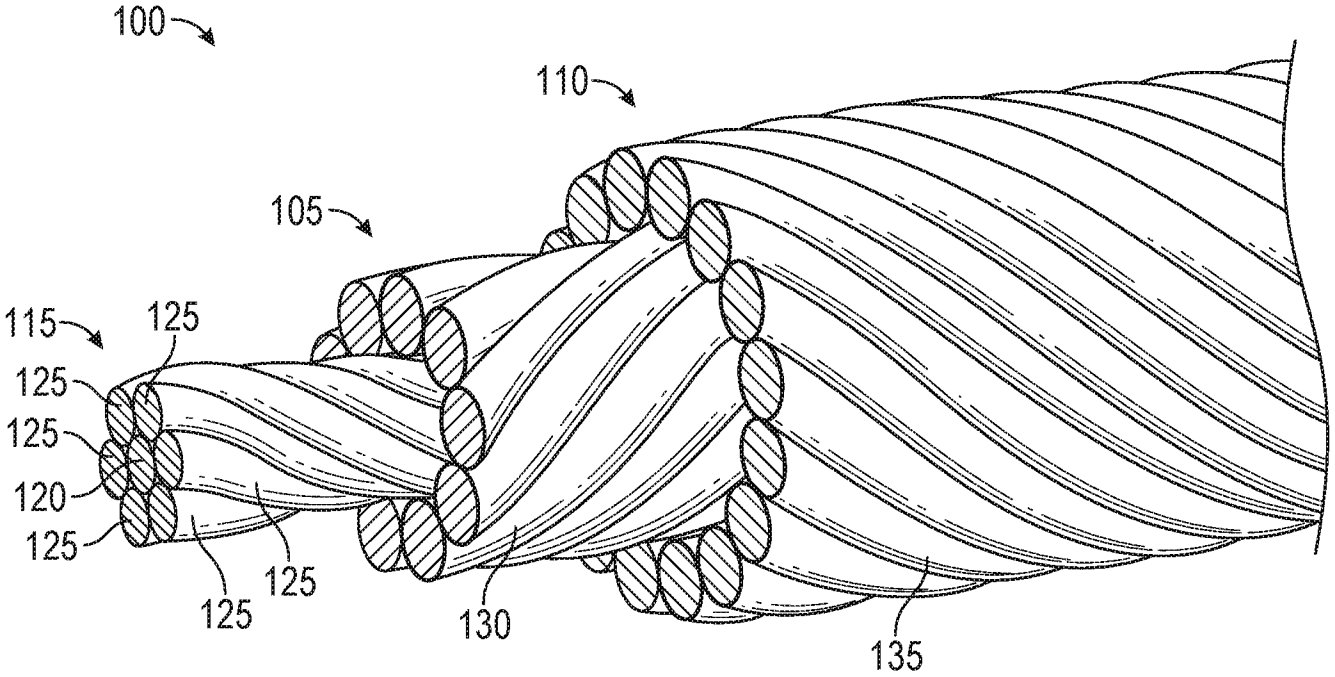
FIG. 1 shows an electrical conductor.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

The first conductors used in overhead applications were homogeneous, being made of individual strands of aluminum or copper, stranded together concentrically around a single center strand. Problems existed with these conductors, including large amounts of sag under mechanical and electrical loadings.

To correct the lack of mechanical strength, and reduce the thermal elongation, steel strands were added to these conductors. The steel strands are concentrically stranded into a "steel core", and then layers of aluminum or aluminum alloy are concentrically stranded around the steel core. While the steel core carries small amounts of current, its primary function is to reduce sag by increasing strength and reducing thermal elongation of the completed conductor.

Steel cores may be replaced with composite cores. These composite cores may be homogeneous, light weight, monolithic (i.e., being one large strand), and may have a low thermal elongation compared to steel cores. One disadvantage of composite cores may be poor mechanical performance (e.g., low modulus of elasticity) under mechanical loading. Another disadvantage may be that fibers in composite cores may be damaged by bending or torsional forces during stranding.

"Concentric-Lay-Stranded Conductor" is a conductor comprising a center core surrounded by one or more layers of helically wound conductor wires. The conductor's "lay" may refer to the length and direction of strands in layers comprising the conductor. The lay length may comprise the axial length of one complete revolution of a helical strand. The lay direction may be defined as right-hand or left-hand, referring to the individual strands' wrap direction as viewed axially in a direction away from an observer. The conductor may comprise, for example, a homogeneous or a non-homogeneous material. Individual strands comprising the conductor may be, but not limited to, round or trapezoidal-shaped.

FIG. 1 shows a hybrid core conductor 100 consistent with embodiments of the invention. Hybrid core conductor 100 may comprise a high-capacity, high-strength stranded conductor used, for example, in overhead power lines. Hybrid core conductor 100 may include a plurality of conductor strands (e.g., disposed in a first conductor layer 105 and in a second conductor layer 110) and a conductor core 115.

Conductor core 115 may comprise a plurality of core strands. The plurality of core strands may comprise a core center strand 120 with round or shaped core layer strands 125 helical wrapped around core center strand 120. While FIG. 1 shows conductor core 115 having one center strand and one layer of strands around the center strand, conductor core 115 is not so limited. Conductor core 115 may comprise any number of strands in any number of layers arranged in any orientation. For example, conductor core 115 may comprise one core center strand 120 and seven core layer strands 125.

Second conductor layer 110 may be helical wrapped around first conductor layer 105. First conductor layer 105 may be helical wrapped around conductor core 115. First conductor layer 105 and second conductor layer 110 may be wrapped in respective alternating hand lay. First conductor layer 105 and a second conductor layer 110 may comprise conductor strands that have a trapezoidal cross-sectional shape. Moreover, first conductor layer 105 and a second conductor layer 110 may comprise conductor strands that are compacted. First conductor layer 105 may comprise first conductor layer strands 130. Second conductor layer 110 may comprise second conductor layer strands 135. First conductor layer strands 130 and second conductor layer strands 135 may be considered within the plurality of conductor strands. First conductor layer strands 130 and second conductor layer strands 135 may comprise aluminum or an aluminum alloy that may be chosen for aluminum's high conductivity, low weight, and low cost.

Core center strand 120 and core layer strands 125 may comprise core strands. Any one or more of the plurality of core strands (e.g., core layer strands 125 and core center strand 120) may comprise a first material (e.g., steel, standard strength steel, high strength steel, extra high strength steel, ultra-high strength steel, aluminum zirconium, or 1350-"O" temper aluminum), providing strength to conductor 100. In addition to the first material, any one or more of the plurality of core strands (e.g., core layer strands 125 and core center strand 120) may comprise a composite material, such as, but not limited to fibers (e.g., carbon fibers) disposed in a thermoplastic matrix (e.g., polyphenylene sulfide) . The first material, for example, may have a higher elasticity modulus than the composite material, the first material may have a higher thermal elongation than the composite material, and the first material may have a higher conductivity than the composite material.

Any one or more of the plurality of core strands may comprise a composite core as described in United States Patent Application Publication US 2012/0261158A1, which is incorporated herein by reference in its entirety. For example, the composite material may have any one or more of the following: an elastic modulus in a range from about 70 GPa to about 300 GPa; a density in a range from about 1.2 g/cc to about 1.8 g/cc; a strength to weight ratio in a range from about 500 MPa/(g/cc) to about 1,100 MPa/(g/cc); a percent elongation at break in a range from about 1% to about 2.5%; a linear thermal expansion coefficient in the longitudinal direction in a range from about −0.4 to about 5 ppm per ° C.; a bending radius in a range from about 1 cm to about 50 cm; and a void fraction of less than about 6%. Elastic modulus (or modulus of elasticity) may be the mathematical description of an object or substance's tendency to be deformed elastically (i.e., non-permanently) when a force is applied to it. The elastic modulus of an object may be defined as the slope of its stress-strain curve in the elastic deformation region. For example, a stiffer material will have a higher elastic modulus.

As stated above, ones of the plurality of core strands (e.g., core layer strands 125 and core center strand 120) of conductor core 115 may comprise either the first material or the composite material, for example. The first material (e.g. steel, aluminum zirconium, or 1350-"O" temper aluminum) may provide good strength, good ductility, and has a high modulus of elasticity, but has high weight and relatively (compared to the composite material) high thermal elongation. This may make an electrical conductor made with a wholly steel core perform well under mechanical loadings (e.g., ice and wind), but not as well under thermal loads. On the other hand, the composite material may have a high strength to weight ratio, very low thermal elongation, but may break if bent to sharply, and may have a low modulus of elasticity. This may make an electrical conductor made with a wholly composite material core sag more under mechanical loads for example.

Consistent with embodiments of the invention, some of the plurality of core strands may comprise a high modulus of elasticity material, such as steel, and some of the plurality of core strands may comprise a low modulus of elasticity material such as the composite material. Low thermal expansion, low weight materials, such as the composite material, may have a low modulus of elasticity, thus, while they may perform well under thermal loads, they may not perform as well as steel under mechanical loads such as ice and wind. Most high modulus materials, such as steel, may perform well mechanically by having high thermal elongations.

By combining high modulus of elasticity material and low modulus of elasticity material into conductor core 115: i) the low modulus, low weight, low thermally expanding material in conductor core 115 may allow hybrid core conductor 100 to have a high strength to weight ration and lower expansion (i.e., less sag) under thermal loading; and ii) the high modulus material in conductor core 115 may reduce the elongation (i.e., sag) of hybrid core conductor 100 under heavy mechanical (e.g., ice and wind) loading.

Consequently, hybrid core conductor 100 with conductor core 115 that incorporates both a low modulus of elasticity material (e.g., the composite material) and a high modulus of elasticity material (e.g., steel or aluminum zirconium) may improve the modulus of elasticity of the overall construction of hybrid core conductor 100. Accordingly, compared to conventional conductors, hybrid core conductor 100 may have a low weight, low thermal expansion strength member (e.g., core) with a higher modulus, thus able to carry mechanical loads with less sag. Consistent with embodiments of the invention, hybrid core conductor 100 may optimizes both the thermal and mechanical properties of the materials used in conductor core 115.

A hybrid core conductor 100 may be provided. The hybrid core conductor 100 may comprise conductor core 115 and a plurality of conductor strands wrapped around conductor core 115. Conductor core 115 may comprise the plurality of core strands comprising an overall number of strands. The plurality of core strands may comprise a first portion of core strands and a second portion of core strands. The first portion of core strands may comprise a first number of strands. The first portion of core strands may comprise a high modulus of elasticity material (e.g., steel, aluminum zirconium, or 1350-"O" temper aluminum). The second portion of core strands may comprise a second number of strands. The second portion of core strands may comprise a low modulus of elasticity material (e.g., the composite material).

Consistent with embodiments of the inventor, a ratio of the first number of strands to the overall number of strands and a ratio of the second number of strands to the overall number of strands may be optimized to give the conductor core a predetermined characteristic. The predetermined characteristic may comprise, but is not limited to, modulus of elasticity (i.e., elasticity modulus), thermal elongation, and conductivity. For example, the overall number of strands in conductor core 115 may comprise seven (e.g., six core layer strands 125 and one core center strand 120). The first number of strands may comprise one and the second number of strands may comprise six. Consequently, the ratio of the first number of strands to the overall number of strands may be 1:7. This may provide a desired and predetermined modulus of elasticity value for the overall construction of hybrid core conductor 100 by having conductor core 115 incorporate both a low modulus of elasticity material (e.g., the composite material in the second portion of core strands) and a high modulus of elasticity material (e.g., steel in the first portion of core strands).

If the desired and predetermined modulus of elasticity value for the overall construction of hybrid core conductor 100 may not be realized with a ratio of the first number of strands to the overall number of strands of 1:7, this ratio may be modified. By modifying this ratio, a higher modulus of elasticity value for the overall construction of hybrid core conductor 100 may be realized than with a ratio of the first number of strands to the overall number of strands is 1:7. For example, the ratio of the first number of strands to the overall number of strands may be moved to 2:7 by having an overall number of strands in conductor core 115 comprising seven (e.g., six core layer strands 125 and one core center strand 120), the first number of strands comprising two, and the second number of strands comprising five. Similarly, the ratio of the first number of strands to the overall number of strands may be moved to 3:7, 4:7, 5:7, or 6:7 until the optimal predetermined modulus of elasticity value for the overall construction of hybrid core conductor 100 is realized. The ratio of the first number of strands to the overall number of strands may comprise any ratio and is not limited to the aforementioned ratios. The first number of strands, the second number of strands, and the overall number of strands are not limited to the aforementioned values. Other characteristics (e.g., thermal elongation, conductivity, or a combination of any two or more of thermal elongation, conductivity, and modulus of elasticity) may be optimized by adjusting the aforementioned ratios.

Figure 2:
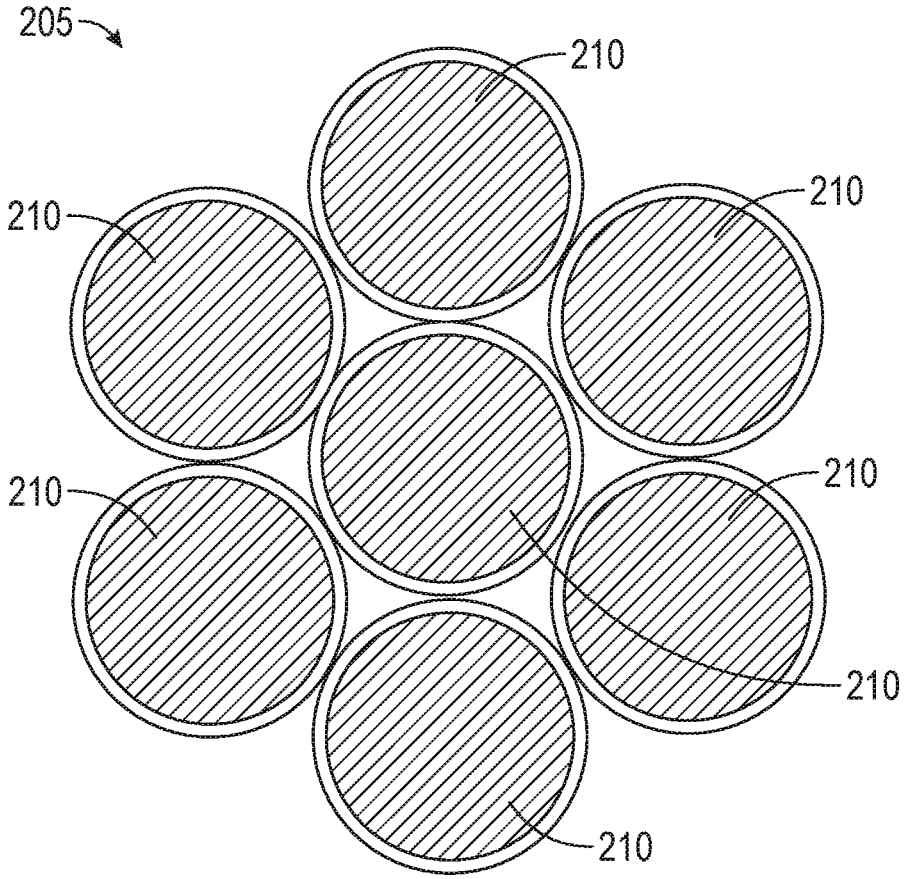
FIG. 2 shows a multi-member strand.

FIG. 2 shows a multi-member strand 205. As stated above, conductor core 115 may comprise core center strand 120 with core layer strands 125 helical wrapped around core center strand 120. Any one or more of the plurality of core strands (e.g., core center strand 120 and core layer strands 125) may comprise multi-member strand 205. While conductor core 115 may have one center strand and one layer of strands around the center strand, conductor core 115 is not so limited. Conductor core 115 may comprise any number of strands in any number of layers arranged in any orientation.

As shown in FIG. 2, multi-member strand 205 may comprise a plurality of filaments 210. Each one of plurality of filaments 210 may comprise different materials selected and optimized to give strand 205 desired overall characteristics. Ones of plurality of filaments 210 may comprise different characteristic that when aggregated together give multi-member strand 205 a desired characteristic or characteristics. Such characteristic may comprise, but are not limited, to modulus of elasticity and thermal elongation. For example, multi-member strand 205 may comprise low-thermal elongation filaments that may improve tension sharing between plurality of filaments 210 and also allow for higher tensile filaments (e.g., steel). For example, the more steel is drawn, the more cold working thus the higher the tension, but lower ductility.

Consistent with embodiments of the invention, for example, the modulus of elasticity and the thermal elongation of multi-member strand 205 may be optimized. Modulus of elasticity and the thermal elongation are examples and other characteristics may be optimized. To optimize the modulus of elasticity, a material with a low modulus (e.g., carbon fiber) may be used in a first portion of plurality of filaments 210 and another material with a higher modulus (e.g., steel) to improve the overall performance of multi-member strand 205 under heavy mechanical loads may be used in a second portion of plurality of filaments 210. The ratio of the first portion of plurality of filaments 210 to the overall number of filaments in plurality of filaments 210 and the ratio of the second portion of plurality of filaments 210 to the overall number of filaments in plurality of filaments 210 may be optimized to give multi-member strand 205 a desired modulus of elasticity. Each filament may have a thin capping layer over it that may isolate, for example, carbon fiber from aluminum.

To optimize thermal elongation, a material with a high thermal elongation (e.g., steel) may be used in a third portion of plurality of filaments 210 and a material with low thermal elongation (e.g., carbon fiber, metal matrix, high nickel steel) may be used in a fourth portion of plurality of filaments 210. The ratio of the third portion of plurality of filaments 210 to the overall number of filaments in plurality of filaments 210 and the ratio of the fourth portion of plurality of filaments 210 to the overall number of filaments in plurality of filaments 210 may be optimized to give multi-member strand 205 a desired thermal elongation. Ones of plurality of filaments 210 may overlap within the groups comprising the first portion, the second portion, the third portion, and the fourth portion. A number of multi-member strands 205 having different optimized characteristics may be used as core center strand 120 and core layer strands 125 to give conductor core 115 a desired optimized aggregated characteristic or characteristics.

While certain embodiments of the invention have been described, other embodiments may exist. Further, the disclosed methods' stages may be modified in any manner, including by reordering stages and/or inserting or deleting stages, without departing from the invention. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. An apparatus comprising:

a conductor core comprising, a core center strand comprising a composite material wherein the composite material comprises fibers disposed in a thermoplastic matrix, and core layer strands wrapped around the core center strand and being in contact with the core center strand wherein the core layer strands comprise a first portion of core strands comprising a first material and a second portion of core strands comprising the composite material.

2. The apparatus of claim 1, further comprising a plurality of conductor strands wrapped around the conductor core.

3. The apparatus of claim 1, wherein the fibers comprise carbon fibers.

4. The apparatus of claim 1, wherein the thermoplastic matrix comprises a polyphenylene sulfide.

5. The apparatus of claim 1, wherein the composite material has an elastic modulus in a range from about 70 GPa to about 300 GPa.

6. The apparatus of claim 1, wherein the composite material has at least one of the following: a density in a range from about 1.2 g/cc to about 1.8 g/cc; a strength to weight ratio in a range from about 500 MPa/(g/cc) to about 1,100 MPa/(g/cc); a percent elongation at break in a range from about 1% to about 2.5%; a linear thermal expansion coefficient in the longitudinal direction in a range from about −0.4 to about 5 ppm per ° C.; a bending radius in a range from about 1 cm to about 50 cm; and a void fraction of less than about 6%.

7. The apparatus of claim 1, wherein the first material comprises one of the following: steel, standard strength steel, high strength steel, extra high strength steel, and ultra-high strength steel, aluminum zirconium, and 1350-"O" temper aluminum.

8. An apparatus comprising:

a conductor core comprising a plurality of core strands comprising an overall number of strands, the plurality of core strands comprising:

a first portion of core strands comprising a first number of strands, the first portion of core strands comprising a first material, and a second portion of core strands comprising a second number of strands, the second portion of core strands comprising a composite material wherein a ratio of the first number of strands to the overall number of strands and a ratio of the second number of strands to the overall number of strands are optimized to give the conductor core a predetermined characteristic.

9. The apparatus of claim 8, wherein the first material has a higher elasticity modulus than the composite material.

10. The apparatus of claim 8, wherein the first material has a higher thermal elongation than the composite material.

11. The apparatus of claim 8, wherein and the first material has a higher conductivity than the composite material.

12. The apparatus of claim 8, wherein the predetermined characteristic comprises elasticity modulus.

13. The apparatus of claim 8, wherein the predetermined characteristic comprises thermal elongation.

14. The apparatus of claim 8, wherein the predetermined characteristic comprises conductivity.

15. The apparatus of claim 8, wherein the ratio of the first number of strands to the overall number of strands is 1:7.

16. The apparatus of claim 8, wherein the ratio of the first number of strands to the overall number of strands is 2:7.

17. The apparatus of claim 8, wherein the composite material comprises fibers disposed in a thermoplastic matrix.

18. The apparatus of claim 8, wherein the first material comprises one of the following: standard strength steel, high strength steel, extra high strength steel, ultra-high strength steel, aluminum zirconium, and 1350-"O" temper aluminum.

19. The apparatus of claim 8, further comprising a plurality of conductor strands wrapped around the conductor core.

20. An apparatus comprising:

a conductor core comprising a plurality of core strands comprising an overall number of strands, the plurality of core strands comprising:

a first portion of core strands comprising a first number of strands, the first portion of core strands comprising a first material, and a second portion of core strands comprising a second number of strands, the second portion of core strands comprising a composite material wherein a ratio of the first number of strands to the overall number of strands and a ratio of the second number of strands to the overall number of strands are optimized to give the conductor core a predetermined characteristic, wherein the predetermined characteristic comprises one of the following: elasticity modulus; thermal elongation; and conductivity.

* * * * *